US006608598B2

(12) United States Patent
Gee et al.

(10) Patent No.: US 6,608,598 B2
(45) Date of Patent: Aug. 19, 2003

(54) TUNING CIRCUIT FOR EDGE-LOADED NESTED RESONANT RADIATORS THAT PROVIDES SWITCHING AMONG SEVERAL WIDE FREQUENCY BANDS

(76) Inventors: Walter Gee, 1683Cassiar Dr., San Jose, CA (US) 95130-1514; Paul E. Mayes, 1508 Waverly Dr., Champaign, IL (US) 61821-5002

( * ) Notice: Subject to any disclaimer, the term of this patent is extended or adjusted under 35 U.S.C. 154(b) by 0 days.

(21) Appl. No.: 10/041,810

(22) Filed: Jan. 7, 2002

(65) Prior Publication Data

US 2002/0109642 A1 Aug. 15, 2002

Related U.S. Application Data

(63) Continuation of application No. 09/176,360, filed on Oct. 21, 1998, now Pat. No. 6,337,664.

(51) Int. Cl.[7] ..... H01Q 9/00

(52) U.S. Cl. ..... 343/749; 343/745; 343/773; 343/774

(58) Field of Search ..... 343/745, 749, 343/773, 774, 700 MS, 747, 750, 751, 752; H01Q 9/00

(56) References Cited

U.S. PATENT DOCUMENTS 4,780,724 A * 10/1988 Sharma et al. ..... 343/700 MS
4,827,266 A * 5/1989 Sato et al. ..... 343/700 MS
6,337,664 B1 * 1/2002 Mayes et al. ..... 343/749

* cited by examiner

*Primary Examiner*—Hoanganh Le
(74) *Attorney, Agent, or Firm*—Robert J. Depke; Holland & Knight LLC

(57) ABSTRACT

An improved tuning method is used in conjunction with a set of nested electrically conducting cones to increase the frequency band over which the resulting radiating system functions as an electrically small antenna with controlled variation in input impedance. This technique enables switching of the frequency band by means of simple circuits that can be activated by a control voltage.

12 Claims, 9 Drawing Sheets

Prior Art

Prior Art

TUNING CIRCUIT FOR EDGE-LOADED NESTED RESONANT RADIATORS THAT PROVIDES SWITCHING AMONG SEVERAL WIDE FREQUENCY BANDS

This application is a continuation of U.S. application Ser. No. 09/176,360, filed Oct. 21, 1998, now U.S. Pat. No. 6,337,664 B1, issued Jan. 8, 2002 which is incorporated herein by reference.

BACKGROUND OF THE INVENTION

1. Field of the Invention

The present invention relates to broadband antennas. More specifically, the present invention is directed to antennas that are small compared to the operating wavelength over much of the frequency band of operation. The invention further relates to a means of reducing the size of a conical radiating resonator in a manner so that a collection of such resonators provides a repetitive variation in input impedance. The amount of the variation in impedance can be controlled by the selection of lumped tuning elements. The invention provides a means of switching the tuning elements in a manner that yields several wide operating bands having similar performance characteristics, thereby providing an electrically small antenna that can operate across a very wide range of frequencies.

2. Description of the Related Art

For a number of years now radio communication systems have been increasing in complexity and numerous different communications services may be employed by a typical user, even a typical member of the general public. Furthermore, an increasing variety of communications tools is available and in use by the average consumer. Therefore, individuals are using a greater number and wider range of frequencies for these communication purposes. For example, a typical person in day-to-day tasks may use AM and FM radios, cellular telephones and, more recently, GPS systems. This ever-increasing trend in the use of communication devices is not likely to change.

The explosion in the use of communications technology is having an impact on the antennas that are an integral part of the every radio system. However, there are currently no known single, small antenna systems available that can operate as a practical matter across the varied range of frequencies that are currently in use by individuals on a regular basis.

Multiple services may operate on widely disparate frequency assignments. Some systems use spread-spectrum or frequency agile techniques that need much wider instantaneous bandwidths than those used with older modulation methods. The examples set forth above cover the kilohertz range through low gigahertz frequencies. Moreover, this push for wider bandwidth is accompanied by a desire to reduce the physical size of the antenna commensurate with the reductions that have been achieved in the size of the electronic components of the systems that use them. Currently, each of the systems mentioned above typically employs a separate dedicated antenna. As radio communication systems become more integrated, particularly those in vehicular services, it is desirable to employ a single antenna for all functions of the system. However, none are currently available to provide the necessary range of operating capability.

A review of known small-antenna designs confirms this fact. A comprehensive account of the state-of-the-art in small antenna design at that time was given in *Proceedings of the ECOM-ARO Workshop on Electrically Small Antennas,* G. Goubau and F. Schwering (eds.), Fort Monmouth, 1976. The small antenna art in more recent years is summarized in *Small Antennas,* K. Fujimoto, A. Henderson, K. Hirasawa and J. R. James, Wiley, New York, 1987. Two principal methods of reducing antenna size, reactive loading and material coating, are discussed. Since loading with reactive elements reduces the bandwidth of the antenna, resistive loading is often used to regain the lost bandwidth. However, resistive loading results in loss of efficiency and gain.

*A Study of Whip Antennas for Use in Broadband HF Communication Systems,* B. Halpern and R. Mittra, Tech. Rep. 86-1, Electromagnetic Communication Laboratory, University of Illinois, Urbana, 1986 gives an example of one of many attempts that have been made to use lumped loading elements to substantially reduce the length of a whip antenna while retaining the ability to cover a wide range of frequencies. Not only is it difficult to maintain coverage of wide bandwidths with whip antennas, but the problem is compounded by using loading elements to shorten them. Hence, this approach has not been very successful when an objective of the design has been to produce a structure with low profile, a feature that is particularly desirable for vehicular antennas.

A new approach to low-profile antennas that are electrically small was introduced in *Series-Fed, Nested, Edge-Loaded, Wide-Angle Conical Monopoles,* P. E. Mayes and M. O'Malley, Digest of IEEE Antennas and Propagation Society International Symposium, Ann Arbor, Mich., 1993. It was shown there that a conducting cone with apex angle near ninety degrees, even though quite small in terms of the wavelength, could, at a certain frequency, display zero reactance (resonance) at the input terminals. The cone was fed against a ground surface from a coaxial cable (center conductor to tip of cone, shield to ground). The reduction in size was achieved by placing lumped inductive loads between the rim of the cone and the ground surface. It was also shown there that two such cones could be nested, connected in series, fed against ground to a transformer in such a way that low values of reactance could be maintained over a band of frequency. Additional data on edge-loaded conical monopoles are given in *Experimental Studies of Two Low-Profile, Broadband Antennas,* M. F. O'Malley and P. E. Mayes, Electromagnetics Laboratory Report 94-6, University of Illinois, Urbana, 1994.

A resonant radiator formed by the space between two nested open-ended conducting cones is one basic prior-art element that is used in the present invention. A single radiator of this form is shown generally in cross section at 10 in FIG. 1A wherein the polar angle defining cone 11 is ninety degrees. This is an example of the special case where the member 11 is actually a planar circular disc. Accordingly, as used in this specification, the term cone can mean either a metal plate or an open-ended angled cone. The second or upper cone 12 of smaller polar angle is positioned above the lower member 11 with cone 12 having a tip 18 at the center of cone 11 and with the axis of cone 12 substantially coincident with the normal through the center of cone 11. A small circular aperture 14 is provided in cone 11 with its center substantially coincident with the center of cone 11. A coaxial cable 15 is attached to the antenna so that the shield 16 of the cable 15 is electrically connected to the rim of the aperture 14. The center conductor 17 of the coaxial cable 15 is electrically connected to the tip 18 of cone 12. Alternatively, this connection may be accomplished with a panel jack having a center PIN connected to tip 18 of cone 12. The outer conducting shield of the panel jack may be attached to the rim of the aperture 14.

Networks of one or more lumped elements 20 are positioned at respective locations 21*a*, 21*b*, 21*c*, 21*d* spaced around the periphery of the conical antenna between the upper cone 12 and the lower cone 11 as shown in FIG. 1B. The networks are electrically connected to the upper and lower cone members 11 and 12 as shown in FIG. 1A. Usually, several similar networks will be distributed around the periphery of cone 12 in order to render sufficient symmetry to the system to maintain in azimuth the desired degree of uniformity in radiation.

Continuous electronic tuning of an edge-loaded conical resonator was demonstrated in *Tunable, Wide-Angle Conical Monopole Antennas with Selectable Bandwidth,* P. E. Mayes and W. Gee, Proceedings of the Antenna Applications Symposium, Allerton Park, Ill., 1995. The frequency of the high-impedance resonance was varied by placing voltage-variable capacitors (varactors) in series with the inductors on the rim of the cone. FIGS. 2A–2C show possible design choices for the network elements of the prior art. FIG. 2A shows a network comprised of a single inductor 32 as taught by O'Malley and Mayes. FIG. 2B shows an inductor 33 in series with a varactor 34 as used by Mayes and Gee. For a given bias voltage, the network of FIG. 2B is equivalent to the inductor 35 in series with a capacitor 36 as shown in FIG. 2C.

FIG. 2D is an approximate equivalent circuit for the conical radiating resonator of FIG. 1. Since the wave launched between any two coaxial cones is transverse electromagnetic (TEM), the region between the tip and rim of the cone can be represented by a section of uniform transmission line 41 having length 55 equal to the tip-to-rim distance. The line is terminated by the lumped element 20 that represents the net reactance at the rim of the cone and by a resistor 42 that simulates the radiation from the space between the two cones.

The experimental results shown in FIG. 3 indicate that a particular conical radiating resonator of the type shown in FIG. 1 could be tuned from 120 to 260 MHz by changing the varactor bias voltage from zero to 23 volts. For some applications, however, this tuning range (2.17:1) is far from adequate. This is especially true if the antenna is required to provide coverage for a plurality of the services mentioned above.

Furthermore, it was later noted that the combination of inductor and varactor in series produced a rim load with a reactance that varied much more rapidly with frequency than that of the inductor alone. Although it would be theoretically possible to achieve a wide instantaneous bandwidth by using multiple resonators with overlapping bands, more resonators would be required when inductor-varactor loading is used than when the loading is only inductive. In addition, the varactor-tuned system could not be tuned with adequate accuracy in face of time and temperature variations. This follows from the need for the resonant frequencies of the several resonators to be related to one another in a way that preserves the shape of the bandpass characteristic.

Devices of the prior art have been shown to have substantial shortcomings particularly if they are to be used with a plurality of services that employ a wide range of transmission frequencies. In order to provide a single antenna structure that is capable of servicing a wide range of frequencies, it is desirable that the structure be capable of electrical tuning across the different ranges of frequencies to be serviced by the device. Hence, there is need for a simple means of adjusting the coverage in such a manner that a single antenna system can be used over a wider range of frequencies than in the past.

Thus, there remains a need in the art for an antenna that is physically small, has a wide instantaneous bandwidth, and which can be electrically tuned over a still wider range of frequencies. It is therefore an object of the present invention to provide a means of realizing an electrically small antenna with a minimal number of resonant radiators that has several wide instantaneous bands that can accessed quickly and accurately. Additionally, it is a further object of the present invention to provide an electrically small antenna that may be switched to enable a single antenna to operate over a very wide range of frequencies. Other objects and advantages of the present invention will be apparent from the following summary and detailed description of the preferred embodiments.

SUMMARY OF THE INVENTION

The antenna structures of the present invention produce wider instantaneous bandwidth with a given number of conical radiators than is possible using varactors in series with lumped inductance edge loads as disclosed in the prior art. In one aspect of the design, several wide instantaneous bands are available from the same antenna system and they can be accessed quickly and accurately simply by electrical switching. By placing the switched bands adjacent to one another, the antenna system of this invention can cover an extremely wide range of frequency. Advantageously, the switched bands can be chosen to coincide with the separate bands of certain communication services.

The present invention employs a resonant radiator of conical shape with an input impedance that has a large resistive value at a predetermined frequency (resonance) where the maximum dimension of the resonator is small compared to the operating wavelength. The reduction in size is obtained by placing one or more reactive elements at the outer extremity of the radiator. Several radiators are connected in such a manner (series) that the impedance observed at the input port of the system is the sum of the impedances of the individual radiators. The resonances of the individual radiators are chosen to adjust the antenna performance according to desired specifications. For example, the resonances can be made close to one another so that the variation with frequency of the input impedance is minimized. The instantaneous bandwidth of an antenna system that maintains the same level of impedance variation will depend upon the number of resonators in the system.

It is important, therefore, when wide instantaneous bandwidths or very small impedance excursions are desired, to use the reactive loads that provide the needed versatility with a minimum change in reactance with frequency. It has been discovered that switching fixed elements is superior to continuously tuned ones in this regard. Not only is the bandwidth of each resonator adversely affected by the rapid variation of the reactance of series LC tuning elements, but the integrity of the performance versus frequency depends upon the ability to maintain an exact relationship among multiple resonators that are needed to provide a wide instantaneous bandwidth.

In accordance with the present invention, a plurality of open-ended conical radiating resonators employs inductors or capacitors in series with PIN diodes. Application of a variable dc voltage across the PIN diodes allows the antenna structure to be tuned over a very wide band of frequencies.

Another advantage of the present invention is the ability to quickly switch the antenna from coverage of a certain band to coverage of another non-adjacent band. Discontinuous tuning by means of varactors requires the application of a discontinuous bias voltage. Generating such a bias voltage would be an added complication in the system. The antennas of the present invention can be designed so that the switched bands coincide with the desired bands. This remains true even when the desired bands are beyond the range of a varactor-tuned system.

DETAILED DESCRIPTION OF THE PREFERRED EMBODIMENTS

Figure 4:
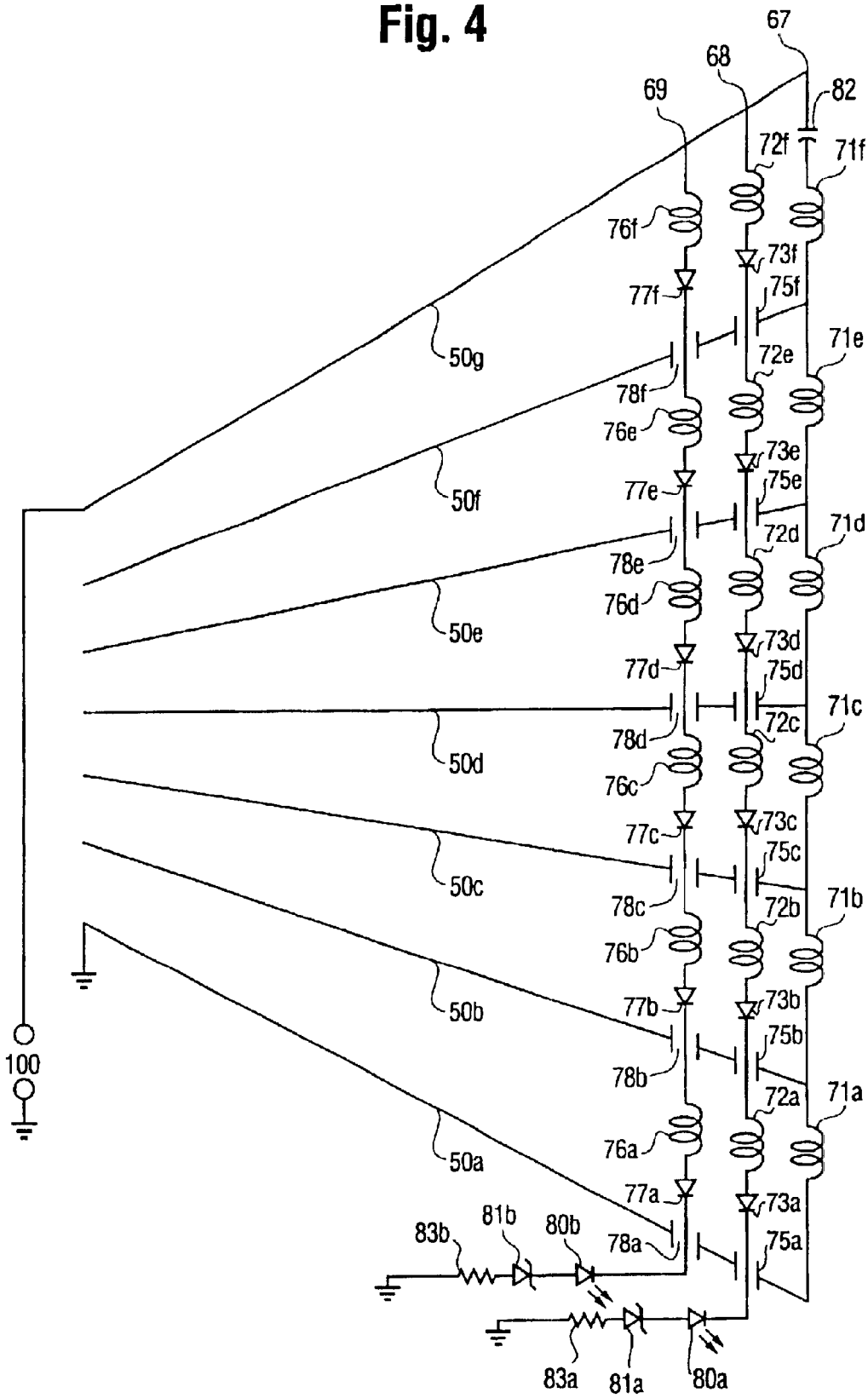
FIG. 4 shows a schematic diagram of an exemplary embodiment of the tuning circuit of the present invention.

The inventors of the embodiments described herein discovered that the insertion of a PIN diode in series with each of a plurality of reactive loads placed across a corresponding plurality of open-ended conical radiating resonators can provide a simple means by which the overall antenna can be electrically tuned across a very wide range of frequencies. FIG. 4 is a schematic cross section near one outer edge of a set of nested open-ended conical resonant radiators having the tuning method that is taught by the present invention. This tuning structure and method overcomes the disadvantages of tuning with varactor diodes. Except for minor parasitic effects, the lumped reactances that determine the resonant frequency of each conical resonant radiator are limited to inductive or capacitive elements. This provides a reactance with lower variation with frequency, and hence wider bandwidth, than the combination of inductors and varactors. The resonant frequency of each conical resonant radiator is determined primarily by the net inductance across the aperture of the conical resonator. The value of this net inductance is controlled by a voltage applied between the top cone 50*g* and the bottom cone 50*a*.

FIG. 4 shows three sets of tuning elements 67, 68 and 69 located near the rim of the conical resonant radiators. The coincidence with a radial plane is for convenience in the drawing, it being understood that the exact location near the rim of each conducting cone 50*a* . . . 50*g* is not critical to the operation of the antenna. The outer set 67 contains only inductors 71*a* . . . 71*f* and a blocking capacitor 82 that prevents dc current through those inductors. The next set 68 contains inductors 72*a* . . . 72*f*, PIN diodes 73*a* . . . 73*f*, a light-emitting diode 80*a*, a zener diode 81*a*, and a resistor 83*a*. The inner set 69 contains inductors 76*a* . . . 76*f*, PIN diodes 77*a* . . . 77*f*, a light-emitting diode 80*b*, a zener diode 81*b* and a resistor 83*b*. A variable dc voltage 100 is applied between the upper cone 50*g* and the lower cone 50*a* (ground). When a conventional transformer with primary and secondary windings is used at the input, the dc voltage can be applied through the transformer secondary. Alternatively, the dc voltage can be applied through a bias tee. Feed-through capacitors 75*a* . . . 75*f* and 78*a* . . . 78*f* permit radio frequency coupling between each of the cones 50*a* . . . 50*g* and the sets of tuning elements 68 and 69 while isolating cones 50*b* . . . 50*f* from the dc source. Feed-through capacitor 75*a* allows the dc path through the set of elements 68 to continue through light-emitting diode 80*a*, the zener diode 81*a*, and the resistor 83*a*. Feed-through capacitor 78*a* allows the dc path through the set of elements 69 to continue through the light-emitting diode 80*b*, the zener diode 81*b*, and the resistor 83*b*.

When the applied dc voltage is zero, all of the PIN diodes will act as large impedances and the inductors 71*a* . . . 71*f* will dominate in the determination of the resonant frequencies of the conical resonant radiators. The inductors 71*a* . . . 71*f* are chosen to produce resonant frequencies near the low end of the desired band of operation. The separation of these resonant frequencies can be used to control the variation in the input impedance, closely spaced resonant frequencies giving the least amount of variation of the impedance with frequency. Conversely, the further apart the resonant frequencies, the greater the instantaneous (unswitched) bandwidth of the antenna. As the dc voltage is increased past the threshold of zener diode 81*a*, the resistances of the PIN diodes 73*a* . . . 73*f* will rapidly decrease to very low values while the resistances of PIN diodes 77*a* . . . 77*f* will remain high until the voltage reaches a level determined by the zener diode 81*b*. The net inductive loads from sets 67 and 68 will then consist of each of inductors 71*a* . . . 71*f* in parallel with each of the corresponding inductors 72*a* . . . 72*f*. Inductors 72*a* . . . 72*f* can therefore be chosen to provide a second set of resonant frequencies displaced a desired amount from the first set. The second set of resonant frequencies can be used to control the variation in input impedance within a second band of operation in a manner similar to that described above.

When the dc voltage is increased just beyond the value determined by the zener diode 81*b*, the resistances of the PIN diodes 77*a* . . . 77*f* will begin to decrease rapidly with increasing voltage until the resistances are near zero and the inductances 76*a* . . . 76*f* will be effectively placed in parallel with inductances 71*a* . . . 71*f* and 72*a* . . . 72*f*. Hence, inductances 76*a* . . . 76*f* can be chosen to provide a third set of resonant frequencies and an accompanying band of operation. The function of the light-emitting diodes 80*a* and 80*b* is to indicate the frequency band to which the antenna is tuned. For the lowest band no diodes would be lit. For the next higher band only diode 80*a* would be lit. For the highest band both diodes 80*a* and 80*b* would be lit. The resistors 83*a* and 83*b* serve to limit the dc current that flows when their respective chains of PIN diodes have low resistance.

Although FIG. 4 shows only three sets of tuning elements 67, 68 and 69, it should be apparent that additional sets could be added to increase the number of bands of operation of the antenna. The set of tuning elements for each additional band would require a zener diode with sufficiently different threshold voltage. FIG. 4 is also limited to the tuning elements at one azimuth angle around the cones. For pattern symmetry, it may be necessary to replicate all sets of tuning elements at several azimuth angles.

Figure 5A:
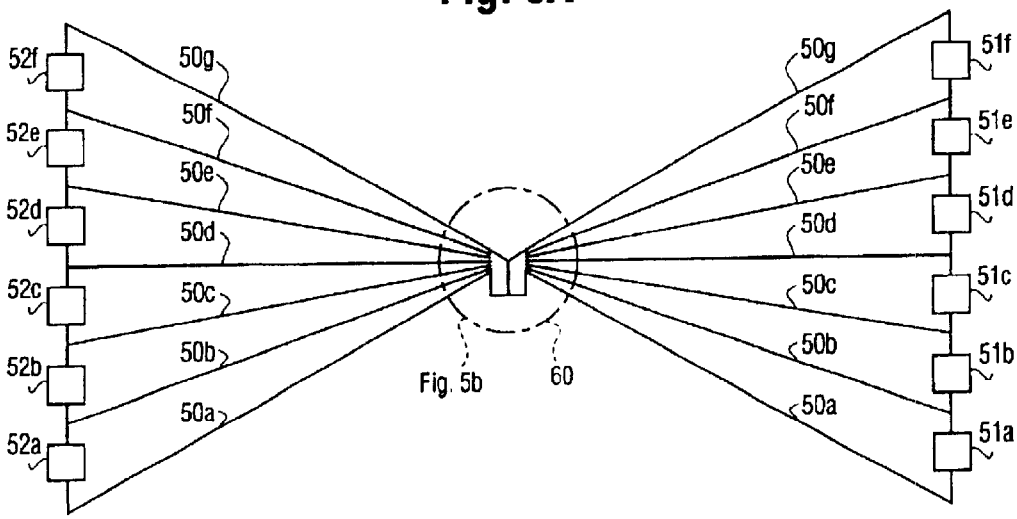
FIGS. 5A and 5B illustrate the complete arrangement of a system of several edge-loaded resonant radiators of conical shape connected in series in which the tuning method of the present invention can be applied.
Figure 5B:
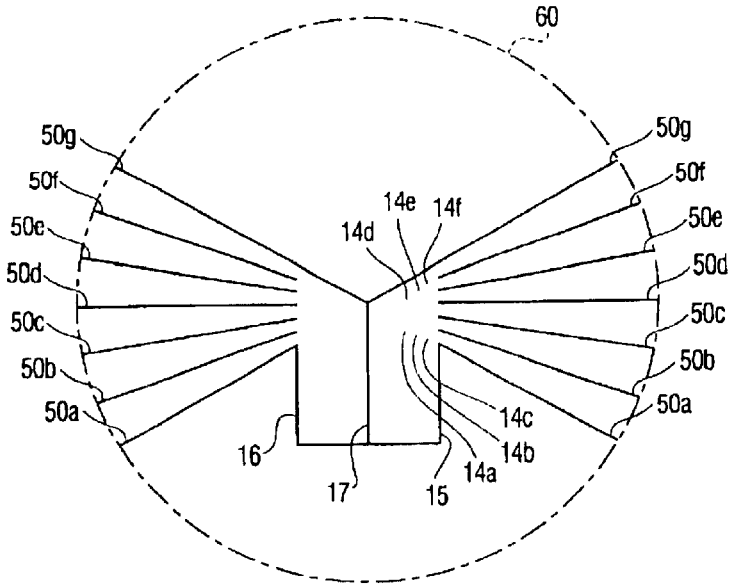

FIGS. 5A and 5B show more completely an antenna system to which the tuning circuitry of the present invention could be applied. FIG. 5A presents a cross sectional view of seven conducting cones, 50*a* . . . 50*g*, arranged as with a common apex and coincident axes, but each cone defined by a different polar angle. The cones are truncated at the far end at the intersection with an imaginary cylinder. FIG. 5B shows an enlarged view of the central part of the cross section of FIG. 5A, which is bounded by the imaginary spherical surface 60. It is there shown that all of the cones except 50*g* are truncated near their tips in another imaginary cylinder, the radius of which corresponds to the inner radius of the shield of a coaxial connector or cable 15. The center conductor 17 of the connector or cable passes through the apertures 14*a* . . . 14*f* in each of the lower cones and is electrically connected to the tip of cone 50*g*. The shield 16 of the connector or cable 15 is electrically connected to the inner rim of cone 50*a*.

Figure 1A:
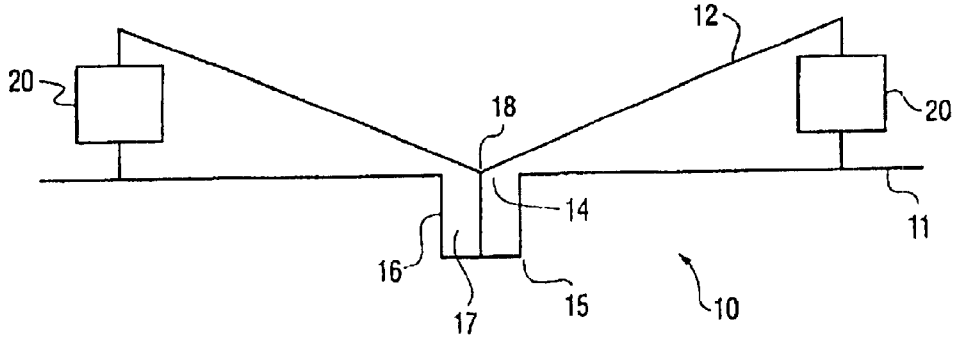
FIG. 1A is a cross section illustration of a prior art single conical monopole, a resonant radiator of conical shape, loaded by two (visible) lumped elements.
Figure 1B:
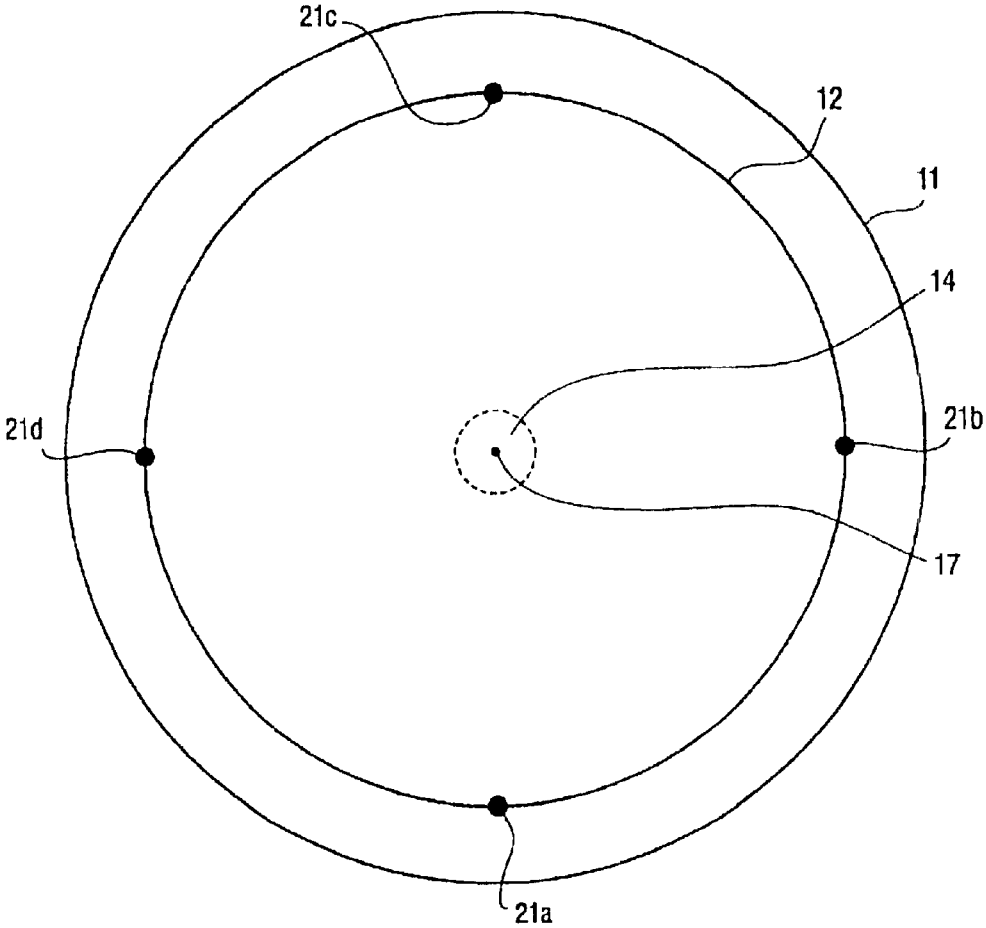
Prior Art Fig. 1B
FIG. 1B shows a top view of the single prior art conical monopole with the connection points for four lumped elements.
Figure 2A:
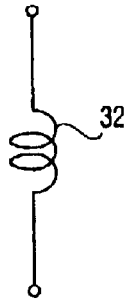
FIG. 2A is a schematic diagram of a prior art lumped element that can be used to produce resonance at a reduced size.
Figure 2B:
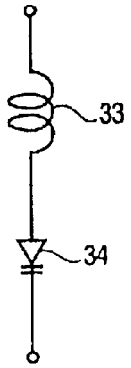
FIG. 2B shows a schematic diagram of a network of prior art lumped elements that can be used to vary the resonant frequency for a given size radiator.
Figure 2C:
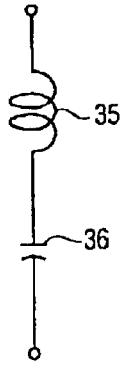
FIG. 2C is an equivalent circuit that can be used for approximate analysis of the circuit of FIG. 2B at a fixed bias voltage.
Figure 2D:
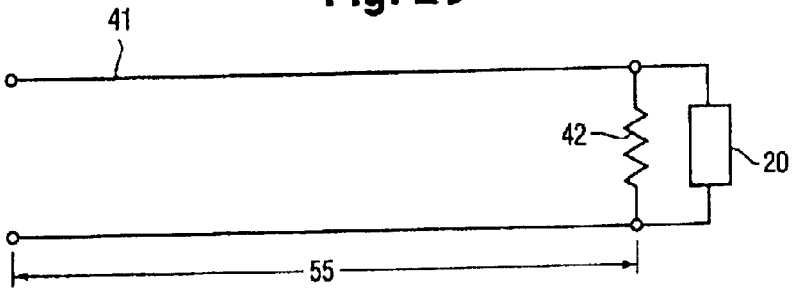
Prior Art Fig. 2D
FIG. 2D is an equivalent circuit that can be used for approximate analysis of the antenna of FIG. 1 for any of the lumped elements of FIGS. 2A, 2B or 2C.
Figure 3:
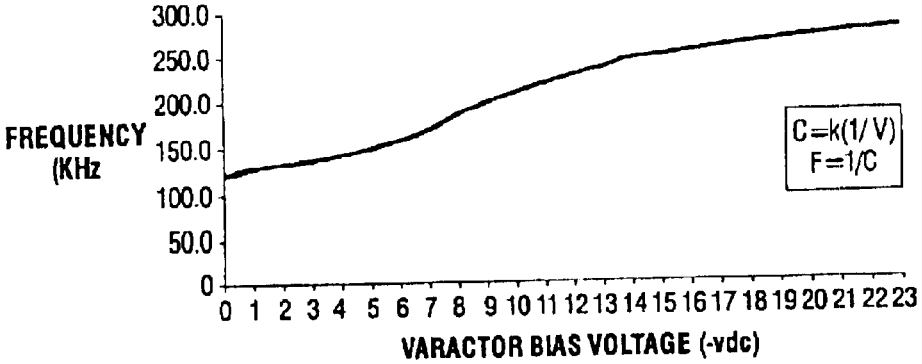
Prior Art Fig. 3
FIG. 3 is a plot of the resonant frequency of an antenna of the type shown in FIG. 1 as a function of the bias voltage applied to an inductor-varactor termination like that shown in FIG. 2B;.

The shape of the imaginary surface that defines the outer edges of cones 50*a* . . . 50*g* is not critical and could take the form of a section of a sphere, the combination of a hemisphere and a circular cylinder, etc. This arbitrariness in the outer boundary of the set of nested cones 50*a* . . . 50*g* arises from using lumped elements 51*a* . . . 51*f* and 52*a* . . . 52*f* (and others that may not be visible in the cross sectional view of FIG. 5A) to determine the resonant frequencies of the set of conical resonant radiators. Note that lumped elements 51*a* and 52*a* are electrically connected between cones 50*a* and 50*b*, lumped elements 51*b* and 52*b* are electrically connected between cones 50*b* and 50*c*, etc. It should be noted that these connections are RF connections through bypass capacitors as illustrated in FIG. 4. As in the single resonant radiator shown in FIG. 1, several sets of lumped elements may be distributed around the periphery of the cones as needed to maintain an adequate degree of azimuthal symmetry in the radiation pattern.

FIGS. 5A and 5B show only the parts of the antenna that are functional at radio frequencies. Thus by-pass capacitors are shown as short circuits and the elements 51*a* . . . 51*f* and 52*a* . . . 52*f* represent the net inductance for a given value of the bias voltage. Mechanical devices may be added as needed to provide support for the parts of the antenna that have electrical function. For example, the space inside the imaginary cylinder which defines the outer boundary of the cones may be filled with a dielectric foam or small pieces of dielectric may be machined to the proper shape and placed between the cones to hold them in the proper position.

Figure 6:
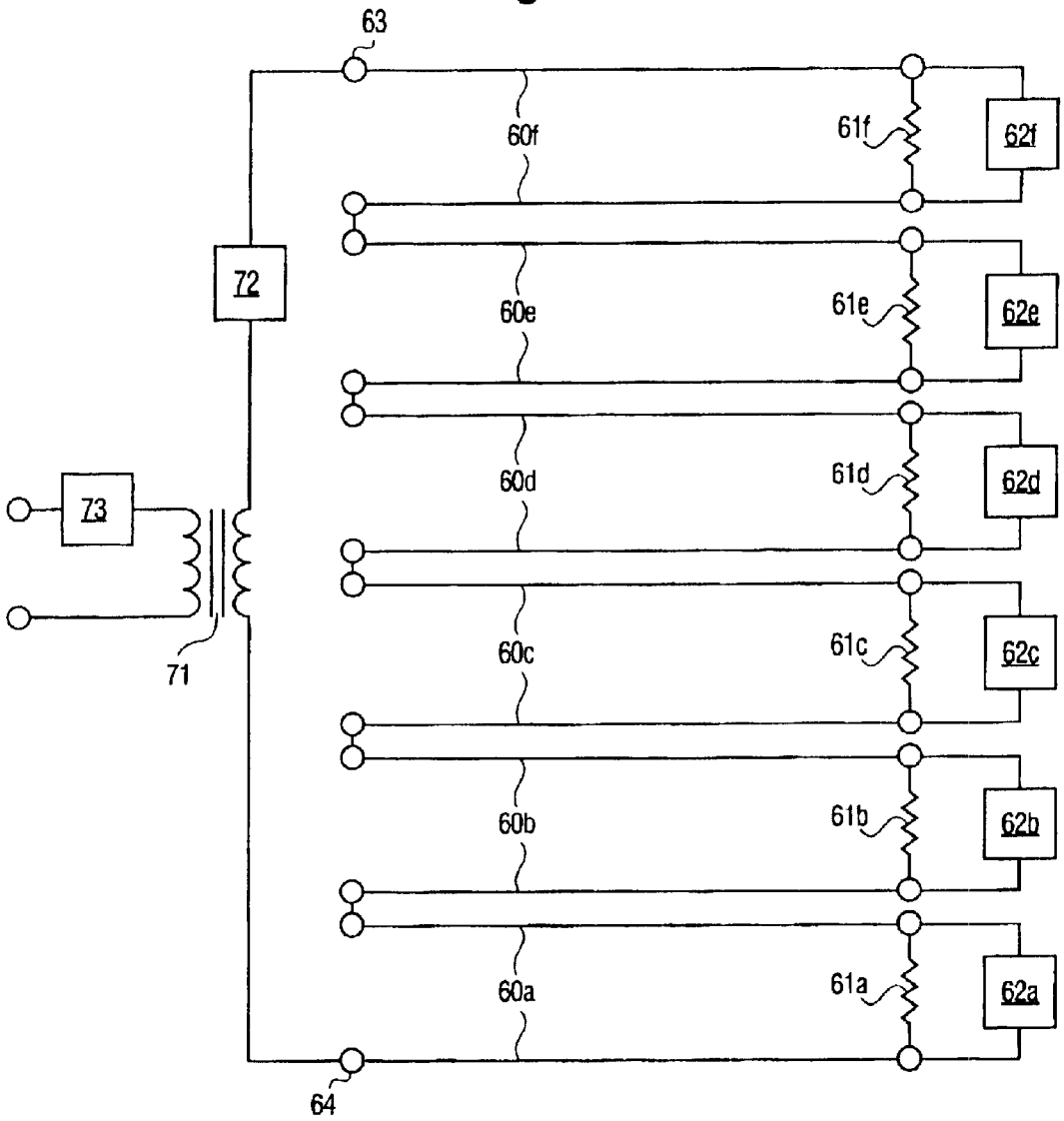
FIG. 6 is an approximate equivalent circuit that can be used for analyzing antennas of the type shown in FIG. 5 when used in conjunction with the tuning circuit of FIG. 4 at a given value of the bias voltage.

An approximate computation of the impedance of the antenna of FIG. 4 can be carried out by solving for the impedance of the equivalent circuit shown in FIG. 6. Each conical resonant radiator is represented by one of the sections of transmission line 60*a* . . . 60*f* which has a characteristic impedance determined by the angles of the corresponding cones and a length equal to the distance between the inner and outer rims of the cones that form its upper and lower walls. Each line is terminated by one of the resistors 61*a* . . . 61*f*, to simulate the radiation from the corresponding resonator, and by one of the lumped elements 62*a* . . . 62*f*, that is applied to fix the frequency of resonance. Since each of cones 50*b* . . . 50*f* is a wall common to two adjacent resonators, the adjacent terminals of lines 60*a* . . . 60*f* are connected so that the sections of line are in series. The remaining free terminals 63 and 64 become the input terminals and correspond to the point of attachment of the center conductor 17 and the shield 16 of the connector or cable of FIG. 5. A transformer 71 and other lumped elements 72 and 73 may be added at the input of the antenna to improve the stability with frequency of the input impedance.

Figure 7:
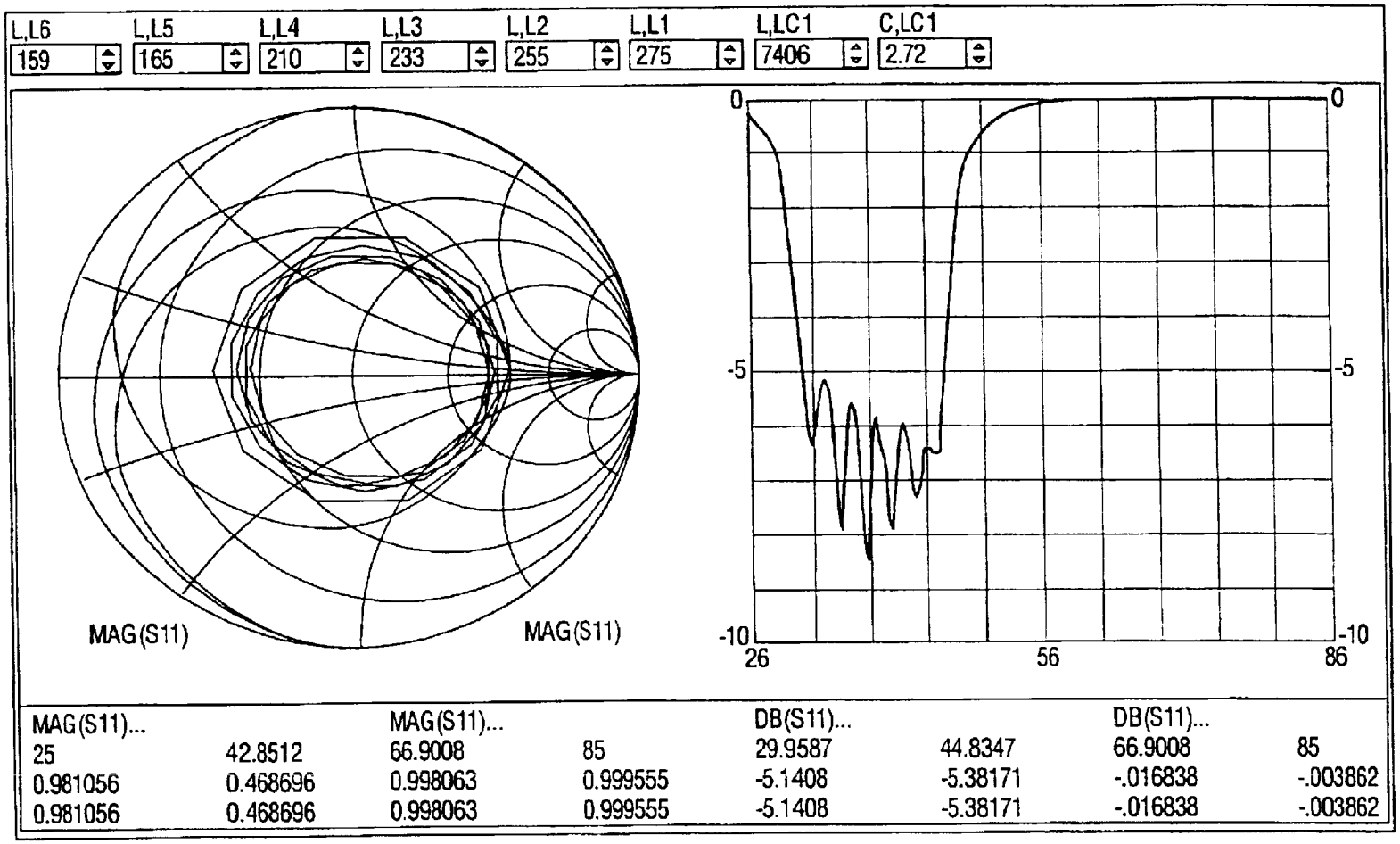
FIG. 7 is a Smith chart plot of the input impedance and a graph of return loss versus frequency computed for a circuit like that shown in FIG. 6.

FIG. 7 is a Smith chart plot of the input impedance and the corresponding return loss of an equivalent circuit representing a nested set of six resonant radiators. The repetitive nature of the input impedance is readily seen in the almost coincident loops on the Smith Chart. It should be noted that the bandwidth of this circuit, using a return loss of 5 dB to define the band limits, is from about 30 to about 45 MHz, a bandwidth of 15 MHz This demonstrates the feasibility of constructing an electrically small antenna having substantial impedance bandwidth using a system of nested conical resonant radiators like that shown in FIG. 5. It further suggests that the bandwidth can be extended by adding more cones. However, it is apparent that there is an upper limit to the number of cones that can practically be utilized.

Figure 8:
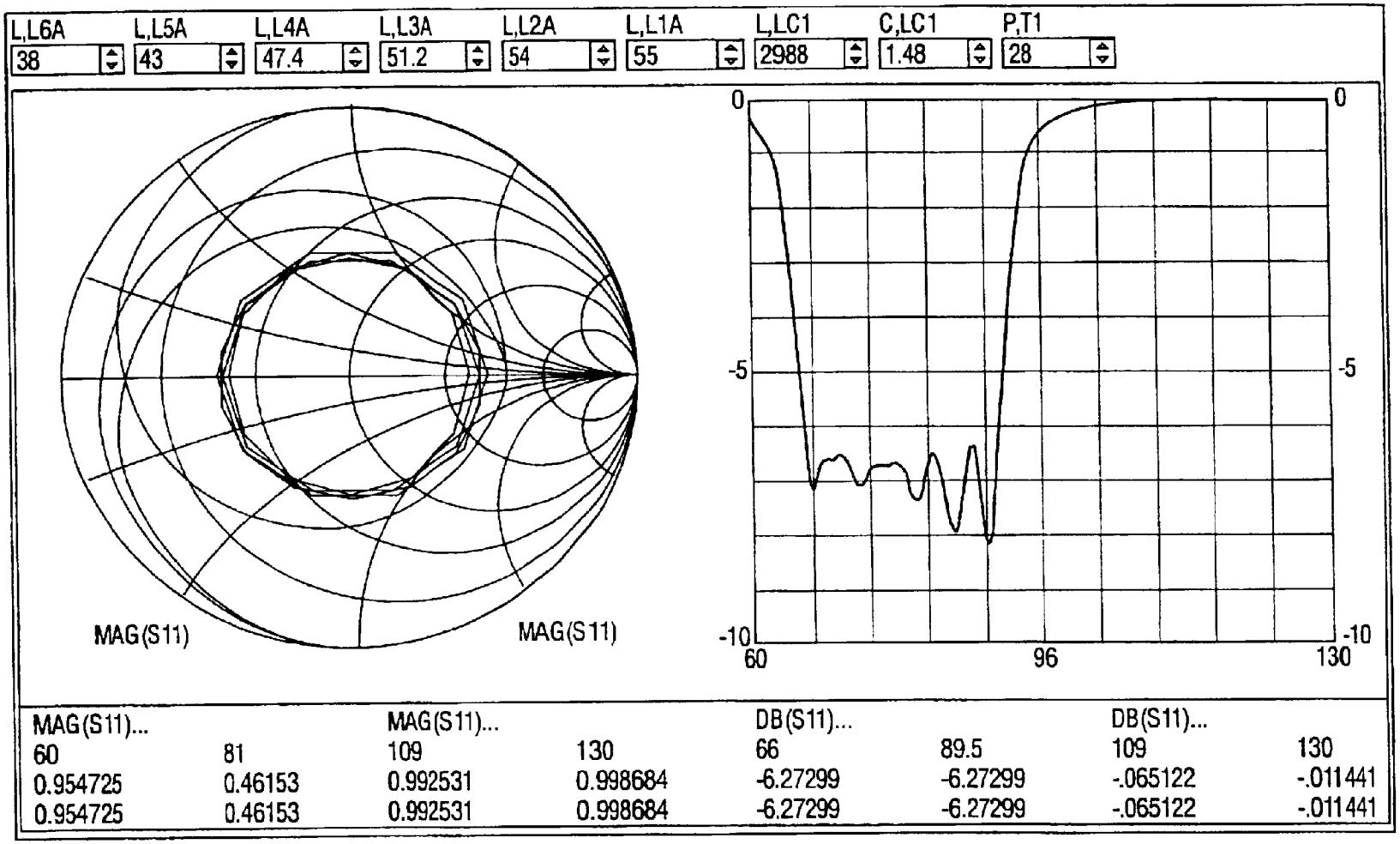
FIG. 8 illustrates an additional Smith chart plot of input impedance and a graph of return loss versus frequency for the circuit shown in FIG. 7 for a different value of the bias voltage.

FIG. 8 is similar to FIG. 7 but for a different set of terminating inductors such as might be obtained by applying enough dc voltage to activate branch 68 of FIG. 4. Note that the loops on the Smith chart are more nearly coincident in this case, indicating that the choice of inductance values is more nearly optimum. Now the return loss remains below 6.5 dB from about 66 to about 89.5 MHz, a bandwidth of 29.5 MHz. The results shown in FIGS. 7 and 8 demonstrate how the tuning circuits of this invention can be used to produce several different operating bands using the same antenna structure. Each band can have a wide instantaneous bandwidth even though the structure is small in wavelengths. The bands can be adjusted in width and return loss by using an appropriate number of radiating resonators. The bands can be separated in frequency as needed to cover the assigned bands of various communications systems. Alternatively, the bands can be placed adjacent to one another to provide a single operating band of great width.

The tuning method of this invention overcomes the disadvantages of tuning with varactor diodes. The lumped reactances that determine the resonant frequency of each conical resonant radiator are limited to inductive or capacitive loads. This provides a reactance with lower variation with frequency, and hence wider bandwidth, than the combination of inductors and varactors. The resonant frequency of each conical resonant radiator is determined primarily by the net inductance across the aperture of the conical resonator. This provides not only a greater bandwidth for each resonator of the system, but also makes possible a wider variety of options for the frequency bands of operation.

It will be appreciated by those skilled in the art that the present invention is not limited to use in conjunction with nested conical antennas. The use of the disclosed circuitry to vary the tuned frequency of an antenna can also work well with a plurality of stacked circular discs which are connected in similar manner to that described with respect to the cones set forth above. Furthermore, other conductive plate configurations and variations in the design can also be used in conjunction with the circuitry disclosed above.

Figure 9A:
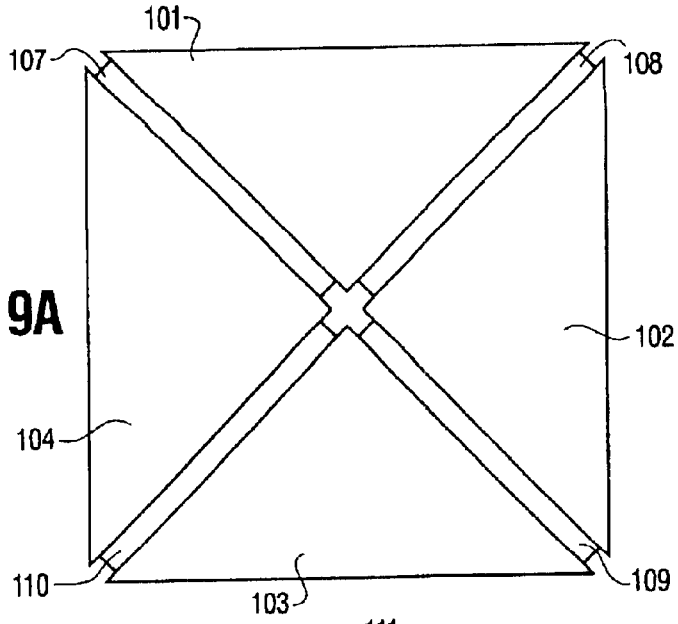
FIGS. 9A and 9B illustrate alternate embodiments of the present invention.
Figure 9B:
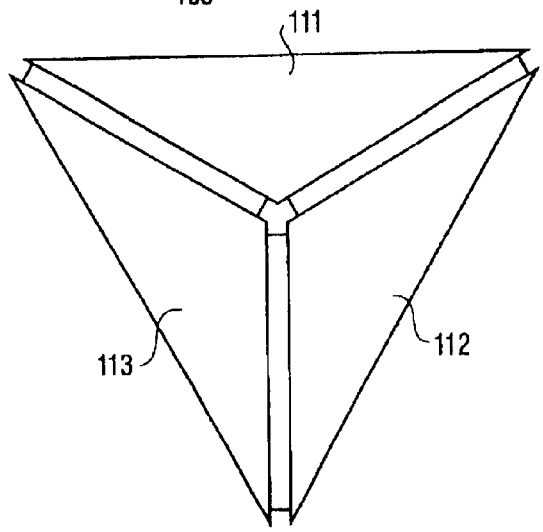

FIG. 9 illustrates one such example of an alternate antenna design that embodies the tuning circuit of the present invention. FIG. 9 is a top plan view of the antenna design. As shown in FIG. 9A, triangular conductive members 101, 102, 103, and 104 are the uppermost conductive sheet layers of a plurality of stacked members. As with the previous designs, this uppermost conductive metal layer is electrically connected to the conductor of a coaxial cable. The coaxial cable passes through an aperture or separation between each of the conductive plates in similar fashion to the design described above. The conductive plates 101, 102, 103 and 104 may be electrically connected to each other along common edges or alternatively an insulating support member may separate each of the planar numbers. As shown in FIG. 9A, this is accomplished by insulating members 107, 108, 109 and 110. FIG. 9B illustrates an alternate embodiment that employs three separate triangular groups of stacked planar members. It will be appreciated that any number of conductive members may be employed. Furthermore, even a single set of stacked angled planar member plates may be employed if it is unnecessary to provide 360° of coverage. Each of these separate groups of planar members may be fed through a common coaxial cable or alternatively four separate feeds may be employed to provide directivity for the antenna. The ability to have separate coaxial connections is obviously only possible for those designs that employ insulative separations. The illustrations set forth in FIGS. 4, 5A and 5B also apply to these embodiments as well except with the alternate modifications noted above. The same advantages with respect to the conical antenna designs set forth above can likely be achieved by these designs as well. However, directivity can also be achieved with the designs of FIGS. 9A and 9B when separate feeds are employed.

Additionally, it will also be recognized that although the PIN diodes disclosed as the switching elements of the embodiments described above are preferred, other switching devices may also be employed. Specifically, transistors could be employed as the switching elements. Transistors would advantageously provide a wider range of tuning for a given voltage, however, the control lines for transmitting the control voltage to the transistors could present a problem in that the scattering of electromagnetic waves from these lines would be a problem that would necessarily be overcome in order to make the transistor switching elements a viable alternative. Once this shortcoming were overcome, transistors could reduce the required range of control voltage for switching the antenna across a given bandwidth. Obviously the use of PIN diodes eliminates this concern but they require a larger control voltage.

Any other type of conventional switch could be used in order to provide tuning for the antenna of the present invention. One new switch element that may be desirable are known as micromachined switches or MEMS. Although they are not yet commercially available, their size would likely be an advantage over other conventional switching elements.

Additionally, alternative reactive elements may be employed to replace the inductor reactive elements of the preferred embodiments. Specifically, for example, capacitors could be used as a substitute for the inductor elements.

Figure 10:
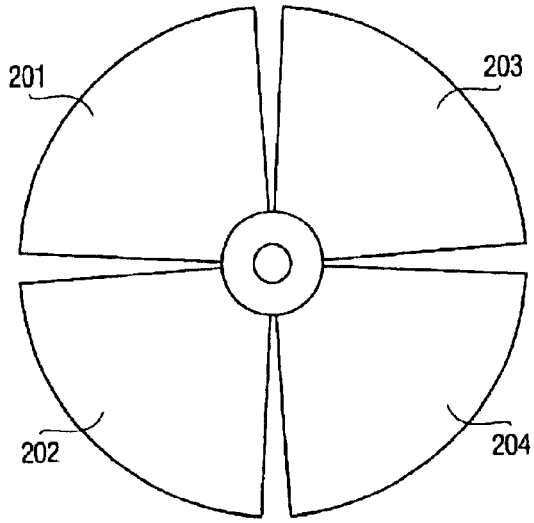
FIG. 10 illustrates yet another alternate embodiment of the present invention.

It should also be noted that the antenna design of the present invention could be rendered collapsible with a flexible structure. In particular, the antenna design of the present invention could be comprised of a plurality of flexible metal petals as shown in FIG. 10. As shown in FIG. 10, a plurality of flexible metal petals 201, 202, 203, and 204 are symmetrically arranged around a central core. Several layers of the metal petals 201, 202, 203, and 204 are provided so that when the structure is expanded it will result in substantially the same structure set forth above with respect to the rigid designs. An insulated lift mechanism that is not shown is employed to raise and lower the metal petal structure. The tuning circuitry is provided with enough length so that when fully extended, the wire, reactive element and switch are pulled taught. It is preferred that the structure be of a rigid design in order to eliminate wear on the device.

Figure 11:
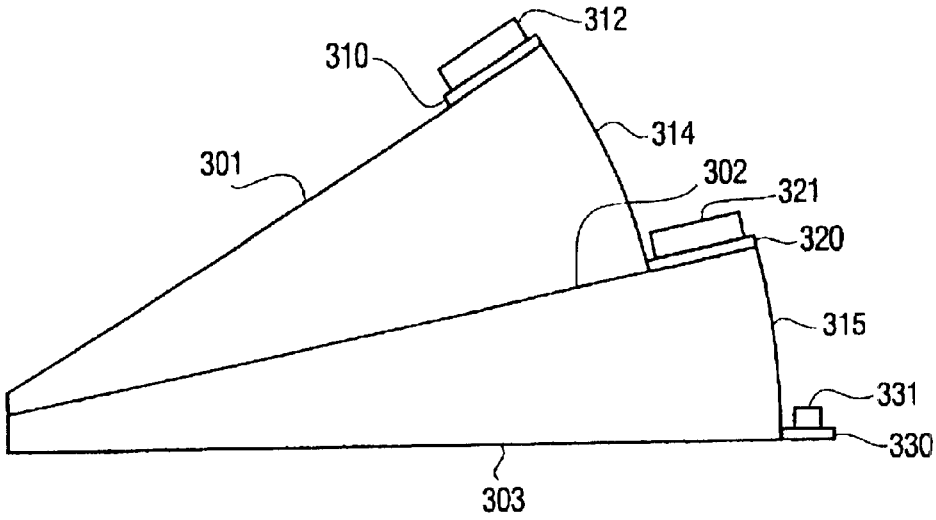
FIG. 11 illustrates a further embodiment of the collapsable antenna design.

In a further specific embodiment of the collapsable design illustrated in FIG. 11, a plurality of flexible metallic cones 301, 302 are arranged above a planar metal plate 303. Upper flexible cones 302 and 303 are arranged such that when centrally secured, they will be biased toward an expanded condition as shown in the figure. However, due to the flexible nature of the element 301 and 302, a downward force will render the antenna inoperable but allow for a lower profile. In this design, in order to effect flexibility of the device, an insulating substrate 310 is placed on the upper element 301. The tuning circuitry previously discussed then is set forth as element 312 on the insulating substrate. A flexible wire 314 connects the circuitry on the upper substrate 310 as previously illustrated to the circuitry on the lower cone. Another insulating substrate 320 is formed on cone member 302. The tuning circuitry 321 is then formed on the insulating substrate 320. This tuning circuitry is similar to that previously discussed with respect to earlier embodiments. Additionally, a flexible wire 315 makes the circuit connections between elements 321 and 331 provided on a further insulating substrate located on the planar member 303. When the device is expanded as illustrated, the antenna functions in a manner similar to that described with respect to the earlier embodiments. However, due to the flexible nature of elements 301, 302 and flexible wires 314 and 315, the entire structure may be collapsed thereby presenting a lower profile.

Figure 12:
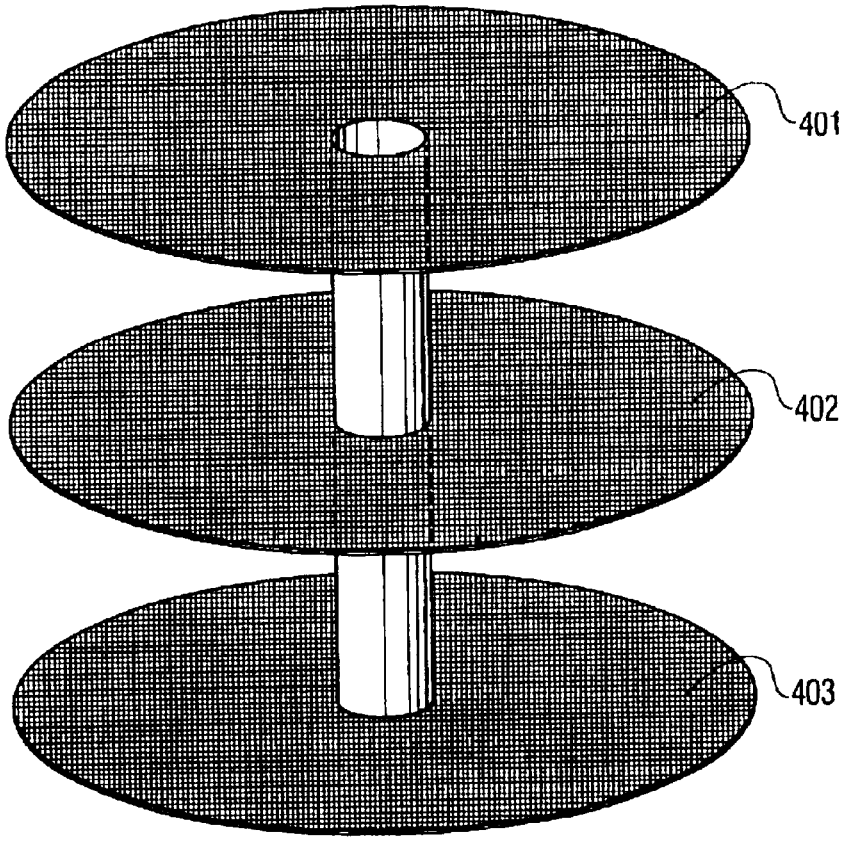
FIG. 12 illustrates an embodiment employing parallel planar mesh discs for the antenna elements.

FIG. 12 illustrates yet a further alternate embodiment wherein planar circular plates 401, 402 and 403 are arranged above one another. The circuitry forming the connection between these planar members is similar to that used with respect to prior designs and is not shown for the sake of convenience. The conductive members 401, 402 and 403 may be comprised of wire mesh planar members as shown in the illustration. Additionally, it will be recognized by those skilled in the art that the planar members may be separated and supported by foam with a hollow central core for locating the coaxial cable so that the center conductor of the coaxial cable may be connected to the top conducting member as with prior embodiments. These elements are not shown for the sake of convenience but are part of the preferred embodiment for this design. This simply illustrates yet an alternate approach to the design of the conductive elements.

The present invention is subject to many variations, modifications and changes in detail. It is intended that all matter described throughout the specification and shown in the accompanying drawings be considered illustrative only. Accordingly, it is intended that the invention be limited only by the spirit and scope of the appended claims.

We claim as our invention:

1. An antenna comprising:

a plurality of overlapping conductive members with a space between adjacent ones of said conductive members;

a plurality of first reactive elements respectively electrically connected between adjacent ones of said conductive members in an outer region of said conductive members;

wherein at least one of the individual overlapping conductive members is segmented such that insulation separates adjacent segments and the segments are conductive portions that extend outward from a center.

2. The antenna of claim 1, wherein said plurality of overlapping conductive elements comprise a plurality of cone members.

3. The antenna of claim 2, wherein said plurality of overlapping conductive elements comprise at least one planar disc member.

4. The antenna of claim 1, wherein said plurality of overlapping conductive elements comprises a plurality of substantially triangular planar members.

5. The antenna of claim 2, wherein said plurality of cone members further comprises a plurality of conductive cone members having an aperture within which a coaxial cable is located.

6. The antenna of claim 5, wherein a center conductor of the coaxial cable is connected to an upper one of said conductive cone members.

7. The antenna of claim 5 wherein the shield element of the coaxial cable is connected to a lower one of said conductive cone members.

8. The antenna of claim 4, wherein the plurality of substantially triangular planar members are arranged in a single stack such that a coaxial cable has its conductor connected to a top one of said planar members and a shield of said coaxial cable is connected to a bottom one of said planar members.

9. The antenna of claim 4, wherein the plurality of substantially triangular planar members are arranged in three groups of adjacent stacks and the respective groups are at least substantially symmetrically arranged such that lines bisecting a central angle of the triangle are spaced by approximately 120 degrees.

10. The antenna of claim 9, wherein a central aperture is formed between the three groups of adjacent stacks and at least one coaxial cable is located in the aperture.

11. The antenna of claim 10, wherein three coaxial cables are located within the aperture and each of the three cables are respectively associated with a single group of substantially planar triangular members.

12. The antenna of claim 11, wherein a central conductor of each of the respective three coaxial cables is connected to corresponding ones of said substantially triangular planar members.

* * * * *